US005080338A

United States Patent [19]

Belanger et al.

[11] Patent Number: 5,080,338

[45] Date of Patent: Jan. 14, 1992

[54] FOLDING APPARATUS FOR ROTARY PRINTING MACHINE

[75] Inventors: Roger R. Belanger, Dover, N.H.; Gilles L. Fecteau, Saco; Richard B. Mack, York, both of Me.

[73] Assignee: Harris Graphics Corporation, Dover, N.H.

[21] Appl. No.: 559,687

[22] Filed: Jul. 30, 1990

[51] Int. Cl.[5] ..... B41F 13/58

[52] U.S. Cl. ..... 270/6; 270/21.1; 270/42; 270/43

[58] Field of Search ..... 270/5, 6, 20.1, 21.1, 270/41, 42, 43, 44, 45, 46, 47, 48-51, 32; 493/340, 363, 364, 365, 370, 324

[56] References Cited

U.S. PATENT DOCUMENTS 4,373,713 2/1983 Loebach .
4,720,089 1/1988 Richter ..... 270/41

FOREIGN PATENT DOCUMENTS 3136882 4/1982 Fed. Rep. of Germany ..... 270/20.1
3237504 4/1984 Fed. Rep. of Germany ..... 270/20.1
1-92669 8/1989 Japan ..... 270/20.1
632720 10/1982 Switzerland .

*Primary Examiner*—Edward K. Look
*Assistant Examiner*—Therese M. Newholm
*Attorney, Agent, or Firm*—Herbert L. Lerner; Laurence A. Greenberg

[57] ABSTRACT

A folding apparatus for a rotary printing machine with two folding formers arranged one behind the other, nip rollers and cutting cylinders for two paper webs longitudinally folding by the folding formers, as well as deflectors, fans and deliveries for streams of folded products formed of the folded paper webs cut by the cutting cylinders, comprising a pair of first frame members carrying the nip rollers and the cutting cylinders therebetween, a second frame member at least partly disposed between the pair of first frames and intermediate the two product streams, idler means, diverter rollers and delivery devices for the folded products being mounted in cantilevered fashion on both sides of the second frame member.

8 Claims, 6 Drawing Sheets

FOLDING APPARATUS FOR ROTARY PRINTING MACHINE

The invention relates to a folding apparatus for a rotary printing machine having two folding formers arranged adjacent one another, the folding apparatus comprising pulling or nip rollers and cutting cylinders for two paper webs longitudinally folded by the formers, deflectors, fans and deliveries for the folded products.

Folding apparatuses having two folding formers arranged in line one behind the other have become known heretofore from Swiss Patent 632 720. In such folders two folder side frames are provided having pulling rollers, cutting cylinders, as well as deflectors, fans, deliveries and required transport means mounted on both sides thereof. The two folder side frames restrict accessibility to the individual folding and transport means, to a great extent, if, for example, a machine part has to be repaired or replaced. Moreover, the two folder side frames are disposed at quite a distance from one another so that the shafts of the pulling and transport means must have a very rigid or stable construction in order to prevent a bending effect.

Another heretofore known folder construction from U.S. Pat. No. 4,720,089 is a dual former folder wherein a respective box frame is disposed intermediate two longitudinally folded paper webs, the box frame being provided as a housing for the drive of the individual formers. This construction has disadvantages in that drive gears and various other drive and control elements provided in this center housing are not readily accessible for the performance of maintenance or repair work thereon, and the necessary gear lubricant or transmission oil result in leakage problems. Due to the great width of the box frame, not only is the distance between the two formers and the folded paper webs increased, but also the overall width of the folder is increased, which is detrimental to the stability of the components. Moreover, this conventional construction requires further frame members in the form of bearing plates wherein the pulling means, cutting devices and deflectors or diverters are mounted, the frame member also being fastened to a base plate. Such frames impede access to the individual folder units, in addition to effecting high manufacturing and assembly costs. Thus, this construction neither improves accessibility to the individual parts nor facilitates the exchange or replacement of specific parts. This heretofore known construction of a folding apparatus is thus quite costly, it being noted moreover that both sides thereof are running, even if only one side thereof is in actual use.

It is accordingly an object of the invention to provide a folder or folding apparatus for high machine speeds having an improved accessibility and operability over heretoforeknown folders of this general type.

With the foregoing and other objects in view, there is provided, in accordance with the invention, a folding apparatus for a rotary printing machine with two folding formers arranged adjacent one another, nip rollers and cutting cylinders for two paper webs longitudinally folding by the folding formers, as well as deflectors, fans and deliveries for streams of folded products formed of the folded paper webs cut by the cutting cylinders, comprising a pair of first frame members carrying the nip rollers and the cutting cylinders therebetween, a second frame member at least partly disposed between the pair of first frames and intermediate the two product streams, idler means, diverter rollers and delivery devices for the folded products being mounted in cantilevered fashion on both sides of the second frame member. The pulling rollers and cutting cylinders which are used have a relatively large diameter and are constructed so as to be very resistant to bending, and can consequently be assembled or mounted in the frame pair without problem. The pulling rollers and cutting cylinders have only a very slight susceptibility to trouble or damage so that the mounting or assembling of the pulling rollers and the cutting cylinders on both sides in the frames does not hinder the pressman in the operation of the machine. The second or center frame member serves for mounting the idler means, the diverter rollers and the delivery devices for the folded products, these components being all cantilevered and fastened to the center frame member, on both sides thereof. Thus, these components are freely accessible and do not require any bearing plates or other additional bearing members which would be detrimental to accessibility. Furthermore, it is possible to employ identical component parts and assemblies, and preassembly of parts or components of the folder according to the invention is facilitated considerably. This embodiment of the folding apparatus is relatively simple in construction and thus cost-reducing, and results in little deflection of the printed products. Moreover, the drive system of the units fastened to the center frame member need not be installed with exacting accuracy.

In accordance with another feature of the invention, there are provided shafts for rotatably supporting the idler means, the diverter rollers and the delivery devices, the shafts being mounted on the second frame member, on both sides thereof, drive means for the nip rollers and the cutting cylinders comprising spur gears mounted outside one of the pair of the first frame members, and drive means for the idler means, the diverter rollers and the delivery devices disposed adjacent the second frame member, on both sides thereof. Due to these advantageous features, the pulling rollers, cutting cylinders, idler means and delivery devices are readily accessible; moreover, the drive for these components is also readily accessible, permitting as straight a guidance of the printed products as is possible.

In accordance with a further feature of the invention, there is provided a drive shaft mounted in the pair of first frame members and in the second frame member, the drive shaft being connected to a drive system outside one of the pair of frame members, and drive means for the idler means, the diverter rollers and the delivery devices disposed adjacent the second frame member, on both sides thereof, the drive means being drivable by the drive shaft. Such a drive has a construction which renders it readily accessible and relatively easy to operate.

In accordance with an added feature of the invention, there are provided timing belts connected to the drive shaft for driving the idler means, the diverter rollers and the delivery devices. By using timing belts, the necessity for oiling parts is avoided.

In accordance with an additional feature of the invention, there are provided clutches carried by the drive shaft for stopping at least one of the idler means and at least one of the delivery devices. Thus when processing only one paper web on one side of the center frame member, the unit on the other side or the idler means, diverter rollers and delivery devices thereof may be stopped. Furthermore, maintenance work may be performed on the "stopped" side, while production goes forward on the other side.

In accordance with yet another feature of the invention, the idler means comprise idler rollers, transport tapes and a deflector formed as a diverter roller pair, and transmission means via which the transport tapes are drivable at a relatively high speed are included.

In accordance with yet a further feature of the invention, the delivery devices comprise fans drivable via reduction gears at a speed lower than the speed at which the transport tapes are driven.

In accordance with still another feature of the invention, the idler means comprise a diverter roller pair adjustably mounted on the second frame member, and including pressure-medium cylinders in operative contact with bearings of the diverter roller pair for engaging and disengaging the diverter roller pair are included.

In accordance with still a further feature of the invention, there are provided two diverter roller pairs, four transport tapes and three fans disposed on the second frame member, on both sides thereof, the cutting cylinders and the diverter roller pairs having a periphery which is three times a format length.

In accordance with a concomitant feature of the invention, the folding apparatus for a rotary printing machine comprises a pair of first frame members carrying nip rollers and cutting cylinders therebetween, a second frame member at least partly disposed between the pair of first frames, idler means and delivery devices for folded products formed from a paper web cut by the cutting cylinders, the idler means and the delivery devices being mounted on one side of the second frame member, and drive means for the idler means and the delivery devices being disposed on one side and adjacent the second frame member.

Other features which are considered as characteristic for the invention are set forth in the appended claims.

Although the invention is illustrated and described herein as embodied in a folding apparatus for a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
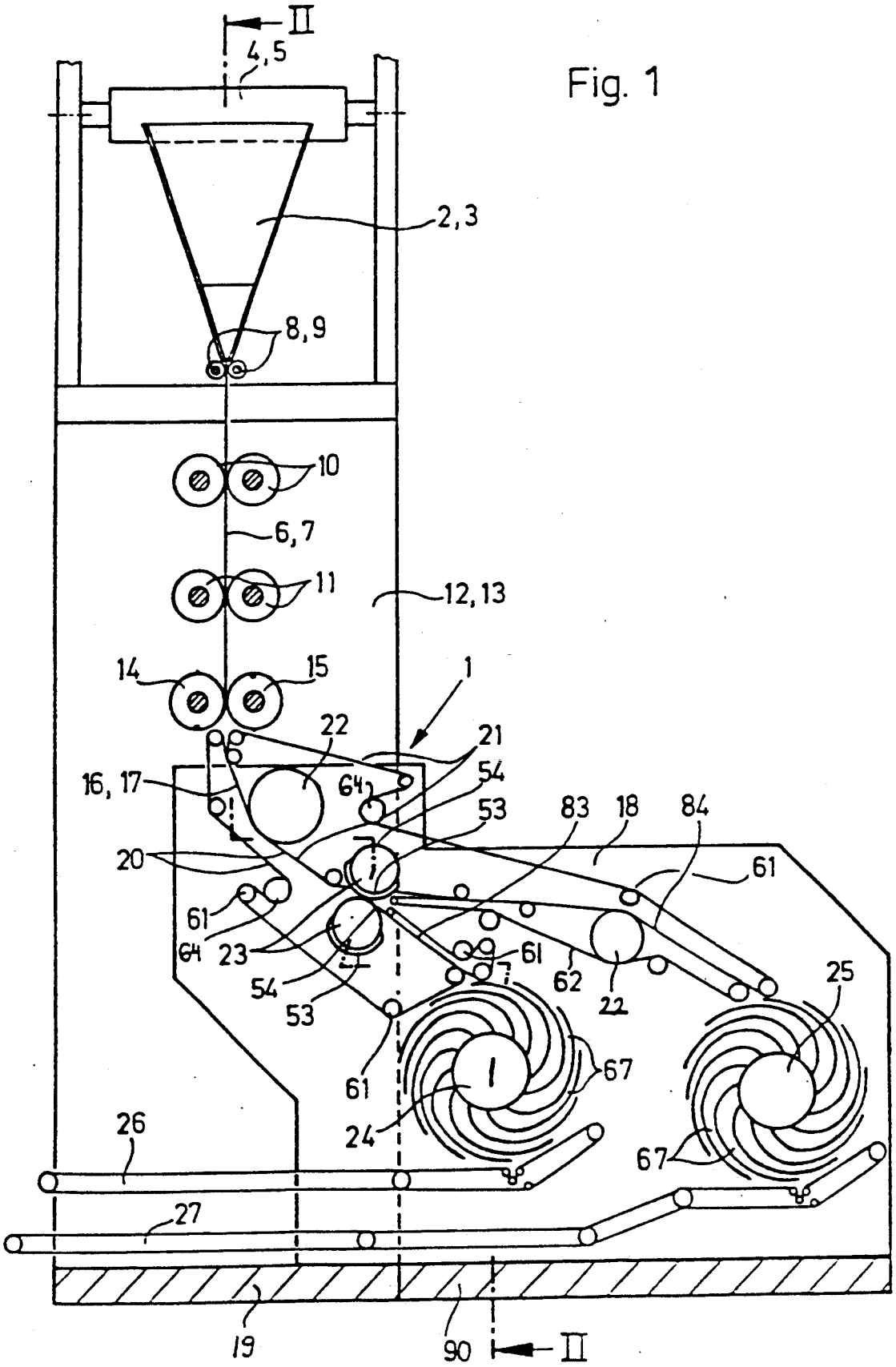
FIG. 1 is a diagrammatic front elevational view of a folding apparatus constructed in accordance with the invention.
Figure 2:
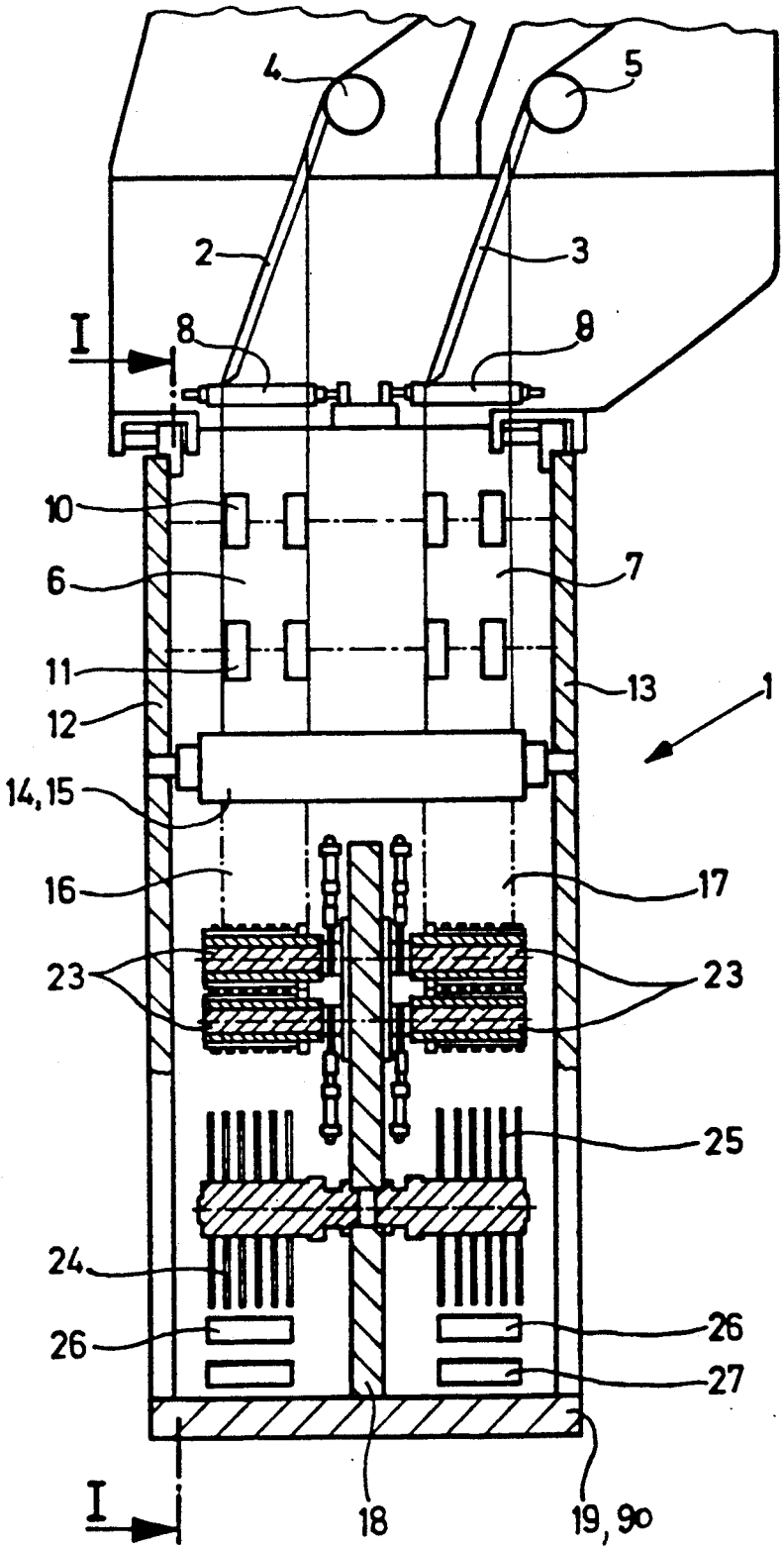
FIG. 2 is a predominantly vertical sectional view of the folding apparatus of FIG. 1 taken along the line II—II in the direction of the arrows.

Referring now to the drawing and, first, particularly to FIGS. 1 and 2 thereof, there is shown therein a folding apparatus 1 provided with two folding formers 2, 3 which are arranged in line one behind the other, the folding formers 2, 3 cooperating with two former rollers 4, 5, respectively. Paper webs 6, 7, are folded longitudinally by the folding formers 2, 3 and are transported, between respective idler roller pairs 8, 9, to respective pulling or nip roller pairs 10 and 11 which pull the paper webs 6, 7 over the folding formers 2, 3. The pulling roller pairs 10 and 11 are mounted between frames 12 and 13 of a frame pair 12, 13. Furthermore two cutting cylinders 14 and 15 are mounted between and in the two frames 12 and 13 of the frame pair 12, 13, the cutting cylinders 14 and 15 extending across both paper webs 6 and 7 for cutting both of them into individual folded products.

In the middle between the two streams 16, 17 of folded products which have been cut off from the paper webs 6, 7 another frame member 18 is arranged between the two frames 12 and 13 of the frame pair 12, 13 in Which the pulling or nip rollers and cutting cylinders are mounted (FIGS. 1 and 2). The frame pair 12, 13 and the center frame member 18 are supported on respective bases 19 and 90, and the center frame member 18 is connected to the frame pair 12, 13 by non-illustrated horizontal ties. The center frame member 18 serves for mounting, guiding and delivery devices for the folded products which are fastened in cantilever fashion to the frame member 18 on both sides thereof and partly extend between the frames 12 and 13 of the frame pair 12, 13.

On each side of the center frame member 18, the guiding and delivery devices are made up of conveyor belts or tapes 20, 21, guide rollers 22 and 61, a diverter roller pair 23 and two fans 24 and 25 via which the folded products are deposited onto two separate delivery devices 26 and 27, as illustrated in FIGS. 1 and 2.

Figure 3:
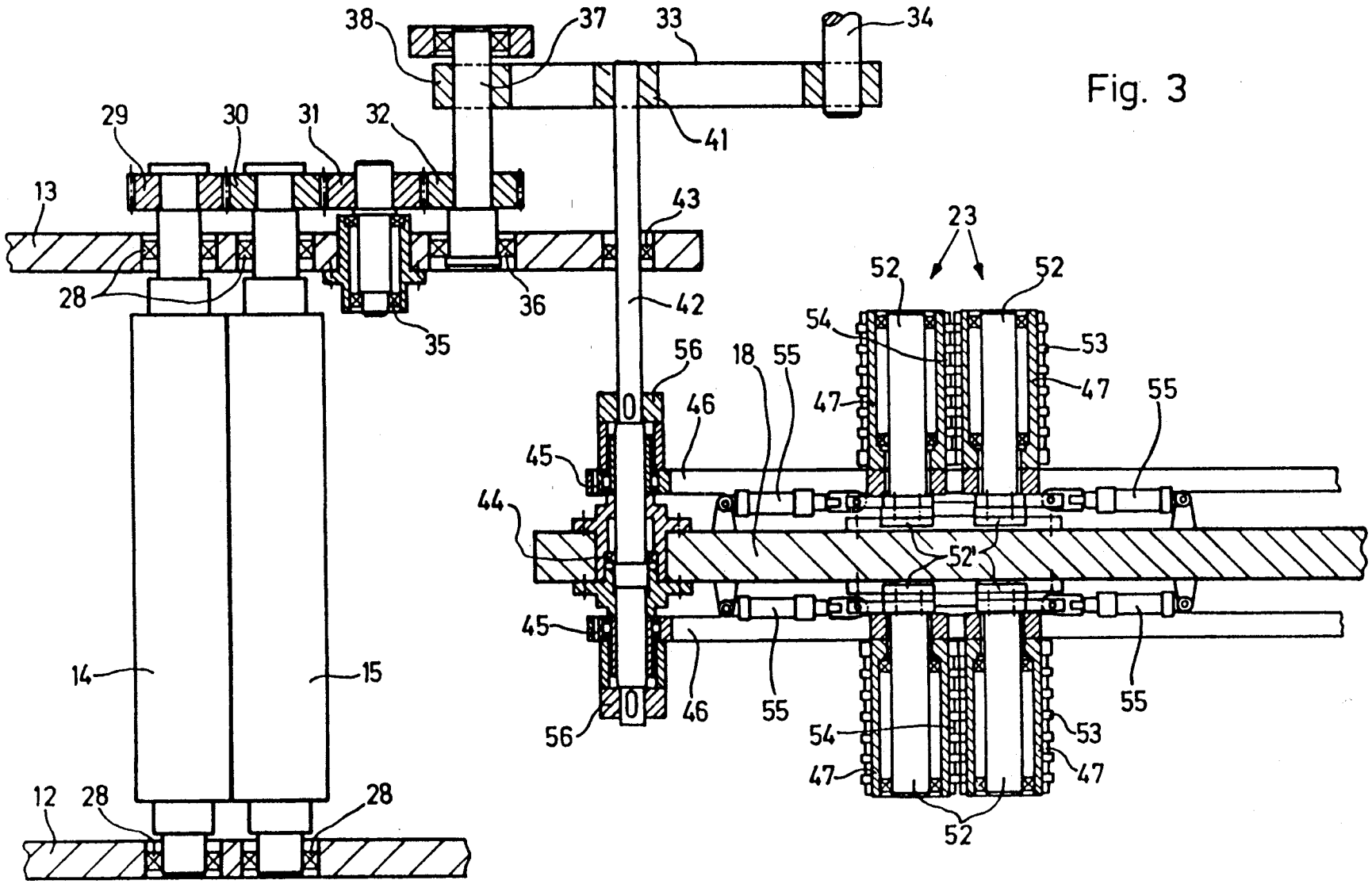
FIGS. 3 and 4 are, respectively, a left-hand portion and a right-hand portion of a predominantly horizontal sectional view of FIG. 1 from a location above cutting cylinders thereof and through respective reduction sprockets and signature-receiving fans thereof, with several of the idler rollers removed.

FIG. 3 shows the two cutting cylinders 14 and 15 which are mounted on and between the frames 12 and 13 by means of bearings 28. At the outside of the frame 13, the two cutting cylinders 14 and 15 are drivable via spur gears 29 and 30. The spur gears 29 and 30 are driven via intermediate gears 31 and 32 and, as represented in the embodiment of FIG. 3, via a belt drive 33, advantageously in the form of a serrated or toothed belt. A drive 34 for the folding apparatus may be provided e.g. by means of an electric motor or the main drive shaft of the printing machines. The intermediate gears 31 and 32 are also mounted on the frame 13 by means of bearings 35 and 36. For the intermediate gear 32 and the drive gear 38 which are mutually connected so as to be fixed against rotation related to one another, it is advantageous to provide an additional drive shaft 37 on which both the intermediate gear 32 and the drive gear 38 of the belt drive 33 are secured.

A timing belt 33 drives a gear 41 which, in turn, drives a drive shaft 42 which is mounted in the frames 13 and 18 by means of bearings 43 and in the center frame member 18 by means of a further bearing 44. In the embodiment illustrated in FIG. 3, the diverter roller pair 23 formed of roller bodies 47 is driven via sprockets 45 and timing belts 46 by the drive shaft 42.

The belts 46 furthermore drive fans 24 and 25 via a reduction transmission 68, timing belts 79 and sprockets 80.

The roller bodies 47 of the diverter roller pair 23 are rotatably mounted on shafts 52 and have, on the outer circumferences thereof, alternate high and low regions 53 and 54 which may divert to different paths the folded products which are to be transported. On one path the folded products reach the first fan 24, as shown in FIG. 1, via a length of a first belt 83 and, on the other path, they reach the second fan 25 via a length of a second belt 84.

By means of pressure-medium cylinders 55, the roller bodies 47 are disengageable from one another via their linear bearings 52' which are located on both sides of the frame member 18. Instead of using pressure-medium cylinders 55 which act on the linear bearings 52' of the roller bodies 47 from outside, it is also possible to adjust the two bearings 52' with respect to one another by pressure-medium cylinders which are provided between the bearings 52' Clutches 56 assigned to the sprockets 45 on the drive shaft 42 permit disengagement of the sprocket 45 on the one or the other side of the frame member 18 so that, when using only one former 2 or 3 and when supplying only one paper web 6 or 7, the respective idler means, diverter rollers and delivery devices which are not needed may be stopped. The clutches 56 may be actuated pneumatically, for example, and thereby coupled with other control functions. The sprockets 45 on the drive shaft 42 drive the timing belts 46 by which, in turn, the idler means, delivery reduction sprockets 68 and the delivery devices, as may be seen in FIG. 4, are driven.

Figure 4:
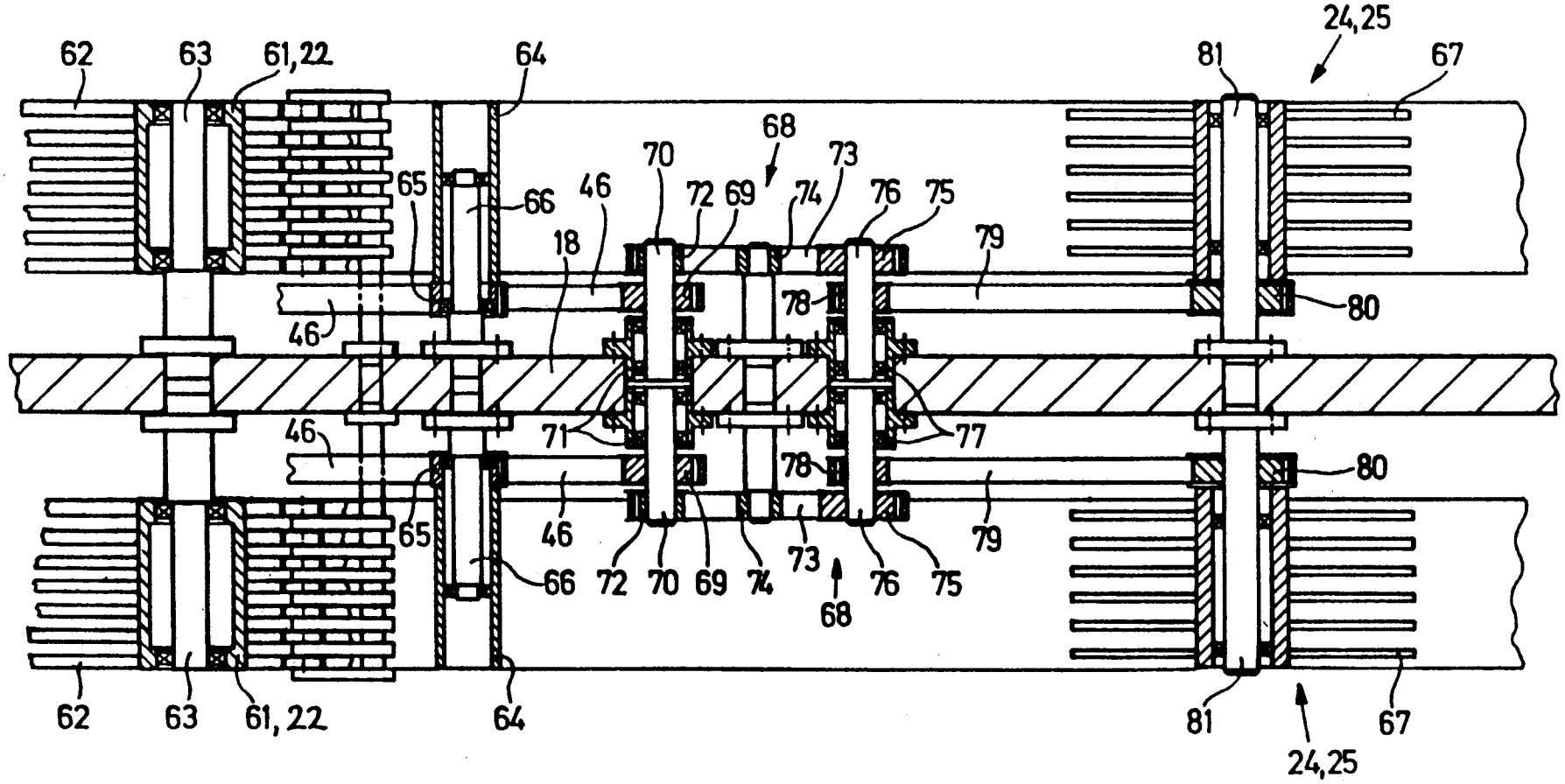

FIGS. 1 and 4 illustrate idler rollers 22 and 61, which are driven only by the transport tapes 20, 21, 62 and 83 and are mounted on journals 63 which, in turn, are fastened to the center frame member 18. Idler rollers 64 differ from the idler rollers 61 insofar as they carry drive sprockets 65 via which the are driven by the timing belts 46 and thus serve for driving the transport tapes 62. The idler rollers 64 also are cantilevered on journals 66 in the center frame member 18 so that the machine operator is able to observe the transport of the products very well and to counteract in a relatively simple manner any possible trouble which may occur.

Because the fans 24 and 25 must be driven at a reduced rate of speed which depends upon the respective number of fan blades 67, a reduction transmission 68 as provided which comprises reduction gears or sprockets 69 driven by timing belts 46. The sprockets 69 are mounted on journals 70 which are, in turn, mounted in the center frame member by means of bearings 71. Gears or sprockets 72 which drive timing belts 73 are mounted on the journals 70. The timing belts 73 are tensioned by tensioning rolls 74 and drive sprockets 75 which, in turn, are mounted on other journals 76. By means of bearings 77, the journals 76, are also mounted in the center frame member 18 and carry sprockets 78 which drive timing belts 79. Via sprockets 80, the timing belts 79 drive the fans 24, 25. The fans 24 and 25 are mounted on journals 81 which are also fastened to the center frame member 18.

In order to achieve the required reduction of speed for driving the fans 24 and 25, the sprockets 69 have a larger diameter than that of the sprockets 72, and the sprockets 75 have a larger diameter than that of the sprockets 78. As a result thereof, the required reduction of speed is achieved in a relatively simple manner. Of course, it is possible to use other drive means, e.g. roller chains, sprocket chains or the like, instead of timing belts.

Figure 5:
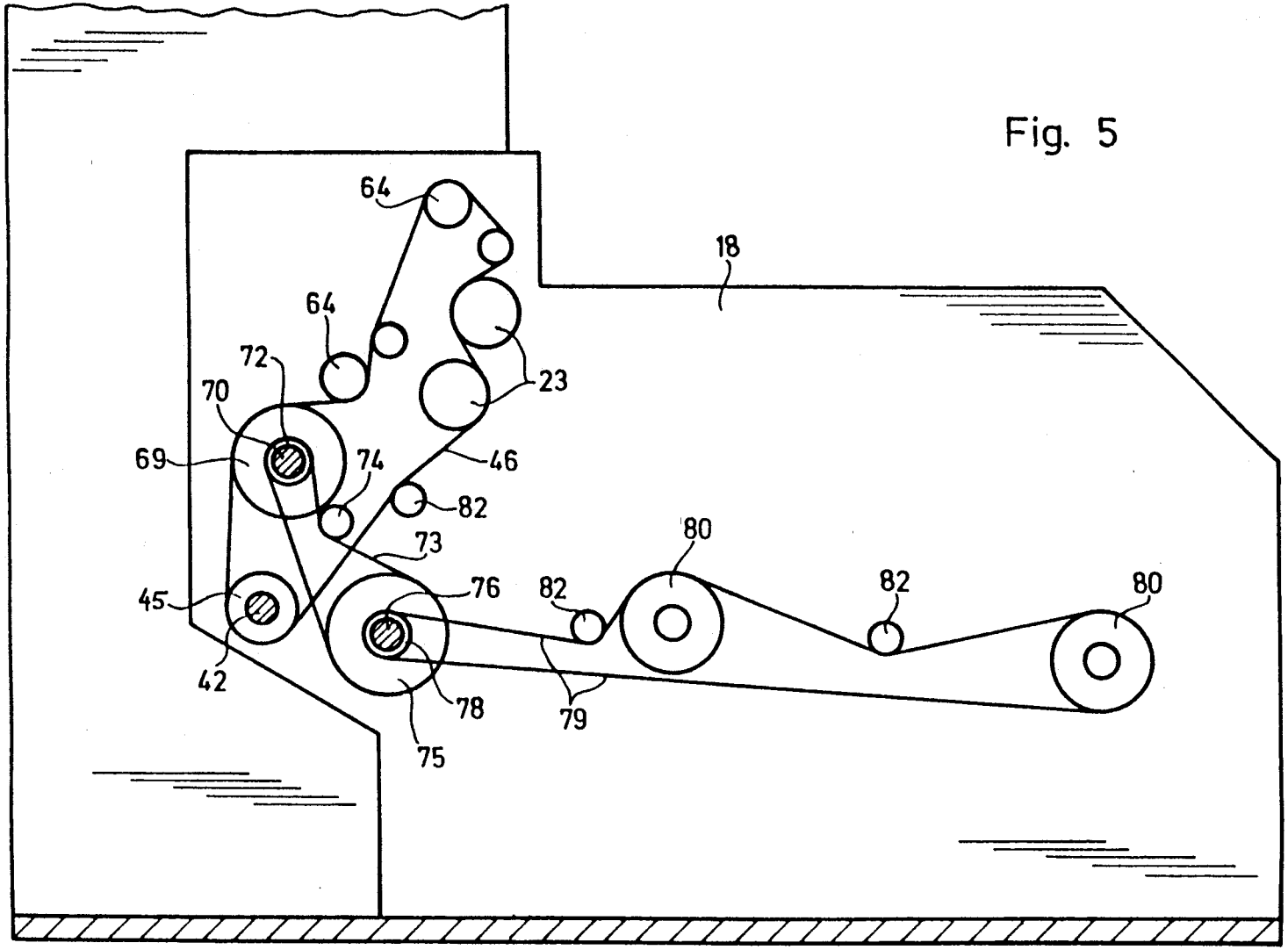
FIG. 5 is a diagrammatic sectional view of FIG. 2 taken along the line I—I, showing the center frame drive system for the folding apparatus.

FIG. 5 is a diagrammatic view of the various drives for the folding apparatus, the timing belts used being tensioned in a conventional manner by tensioning rollers 82.

Figure 6:
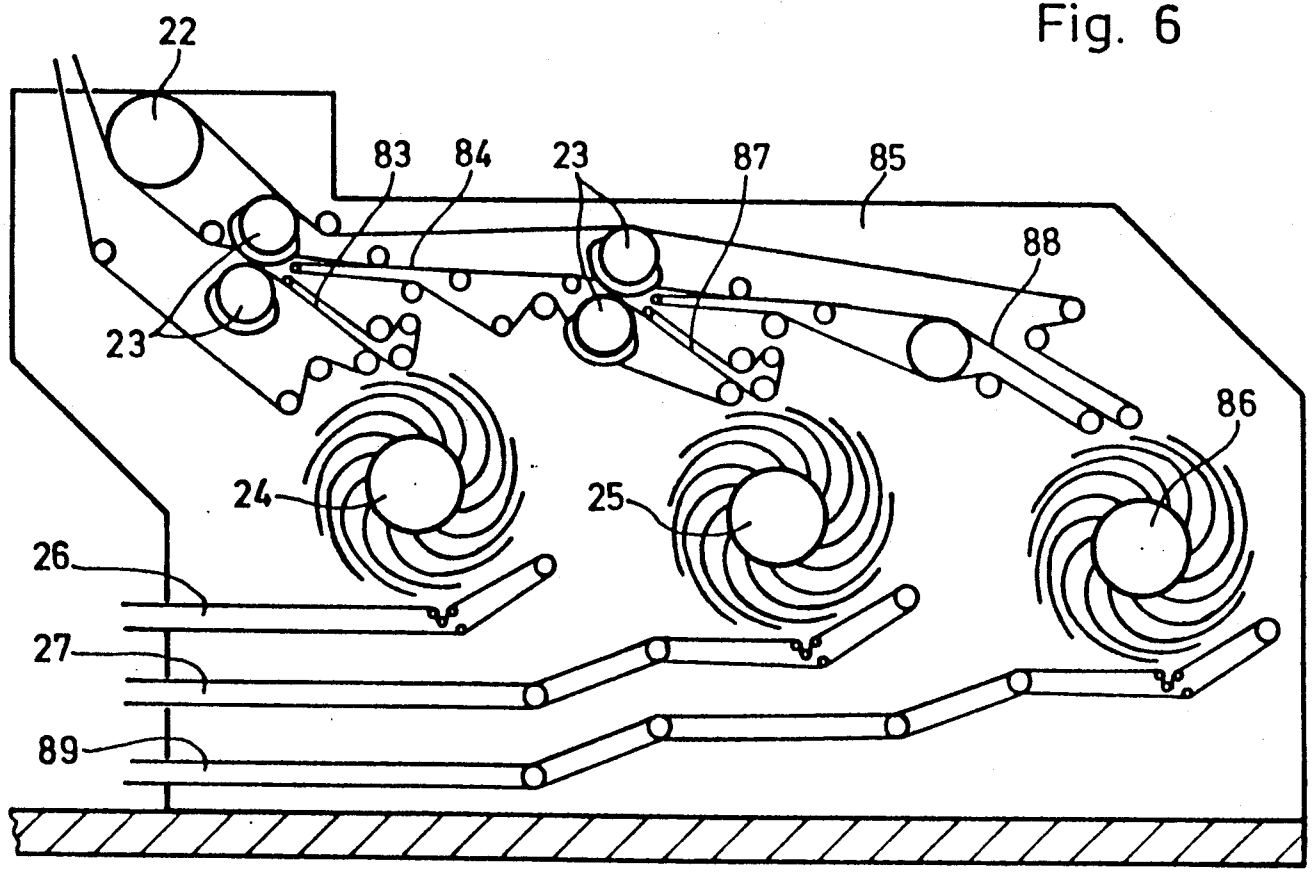
FIG. 6 is a view like that of FIG. 5 of another embodiment of the drive system.

In FIG. 6 there is shown a folding apparatus with another embodiment of the drive system therefor and wherein three fans 24, 25 and 86, respectively, are mounted on both sides of the center frame member 85. An additional diverter roller pair 23 is provided before or upstream of the third fan 86, the folded printed products being fed via the additional diverter roller pair 23 alternatingly to two transport tapes 87 and 88 and are passed thereafter into the respective fans 25 and 86. The folded products of the third fan 86 are then delivered via a third delivery device 89. With this embodiment of the folding apparatus, altogether six different folded products can be delivered, the cutting cylinders 14 and 15 and the diverter roller pairs 23 having a triple periphery corresponding to a triple format length.

We claim:

1. Folding apparatus for a rotary printing machine with two folding formers arranged adjacent one another, nip rollers and cutting cylinders for two paper webs longitudinally folding by the folding formers, as well as deflectors, fans and deliveries for streams of folded products formed of the folded paper webs cut by the cutting cylinders, comprising a pair of first frame members carrying the nip rollers and the cutting cylinders therebetween, a second frame member at least partly disposed between said pair of first frames and intermediate the two product streams, idler means, diverter rollers and delivery devices for the folded products being mounted in cantilevered fashion on both sides of said second frame member, shafts for rotatably supporting said idler means, said diverter rollers and said delivery devices, said shafts being mounted on said second frame member, on both sides thereof, drive means for said nip rollers and said cutting cylinders comprising spur gears mounted outside one of said pair of said first frame members, and drive means for said idler means, said diverter rollers and said delivery devices disposed adjacent said second frame member, on both sides thereof.

2. Folding apparatus according to claim 1, wherein said idler means comprise idler rollers, transport tapes and a deflector formed as a diverter roller pair, and including transmission means via which said transport tapes are drivable at a relatively high speed.

3. Folding apparatus according to claim 2, wherein said delivery devices comprise fans drivable via reduction sprockets at a speed lower than the speed at which said transport tapes are driven.

4. Folding apparatus according to claim 1, wherein said idler means comprise a diverter roller pair adjustably mounted on said second frame member, and including pressure-medium cylinders in operative contact with bearings of said diverter roller pair for engaging and disengaging said diverter roller pair.

5. Folding apparatus according to claim 1, including two diverter roller pairs, six transport tapes and three fans disposed on said second frame member, on both sides thereof, said cutting cylinders and said diverter roller pairs having a periphery which is three times a format length.

6. Folding apparatus for a rotary printing machine with two folding formers arranged adjacent one another, nip rollers and cutting cylinders for two paper webs longitudinally folding by the folding formers, as well as deflectors, fans and deliveries for streams of folded products formed of the folded paper webs cut by the cutting cylinders, comprising a pair of first frame members carrying the nip rollers and the cutting cylinders therebetween, a second frame member at least partly disposed between said pair of first frames and intermediate the two product streams, idler means, diverter rollers and delivery devices for the folded products being mounted in cantilevered fashion on both sides of said second frame member, a drive shaft mounted in said pair of first frame members and in said second frame member, said drive shaft being connected to a drive system outside one of said pair of frame members, and drive means for said idler means, said diverter rollers and said delivery devices disposed adjacent said second frame member, on both sides thereof, said drive means being drivable by said drive shaft.

7. Folding apparatus according to claim 6, including timing belts connected to said drive shaft for driving said idler means, said diverter rollers and said delivery devices.

8. Folding apparatus according to claim 6, including clutches carried by said drive shaft for stopping at least one of said idler means and at least one of said delivery devices.

* * * * *